US010201191B2

(12) United States Patent
Garcia

(10) Patent No.: US 10,201,191 B2
(45) Date of Patent: Feb. 12, 2019

(54) ADJUSTABLE APPARATUS FOR STIFFENING A SHIRT COLLAR

(71) Applicant: Jorge Carlos Gutierrez Garcia, Parkland, FL (US)

(72) Inventor: Jorge Carlos Gutierrez Garcia, Parkland, FL (US)

( * ) Notice: Subject to any disclaimer, the term of this patent is extended or adjusted under 35 U.S.C. 154(b) by 323 days.

(21) Appl. No.: 15/140,973

(22) Filed: Apr. 28, 2016

(65) Prior Publication Data

US 2017/0311649 A1 Nov. 2, 2017

(51) Int. Cl.
*A41B 3/06* (2006.01)

(52) U.S. Cl.
CPC ..... *A41B 3/06* (2013.01)

(58) Field of Classification Search
CPC ..... A41B 3/06; A41B 3/00; A41B 1/14
USPC ..... 2/260
See application file for complete search history.

(56) References Cited

U.S. PATENT DOCUMENTS 454,201 A * 6/1891 Bowyer ..... A41D 27/16 2/60
579,788 A * 3/1897 Brodeur ..... A41B 3/06 2/132
902,576 A * 11/1908 Gustafson ..... A41D 27/18 2/132
1,751,655 A * 3/1930 Oppermann ..... A41B 3/06 2/132
1,820,287 A * 8/1931 Morck ..... A41B 3/06 2/116
1,826,176 A * 10/1931 Hutchison ..... A41B 3/06 2/132
2,004,288 A * 6/1935 Krick ..... A41B 3/06 2/132
2,371,338 A * 3/1945 Manaster ..... A41B 3/12 2/132
2,505,679 A * 4/1950 Less ..... A41B 3/06 2/132
2,510,030 A * 5/1950 Carlisle Jr. ..... A41B 3/06 2/132
2,639,436 A * 5/1953 Gavrilovich ..... A41B 3/06 2/132
2,659,892 A * 11/1953 *Lamont Sharp ..... A41B 3/06 2/132

(Continued)

*Primary Examiner* — Richale Quinn
*Assistant Examiner* — Anne Kozak
(74) *Attorney, Agent, or Firm* — Mark Terry

(57) ABSTRACT

An adjustable apparatus designed to operate with a shirt collar so as to provide stiffness to the shirt collar. A circular, semi-rigid element coextensive with the shirt collar, the semi-rigid element having a gap located at a placket of a shirt. The semi-rigid element comprises a left side having an adjustable first length, and a right side having an adjustable second length. A rearward coupling element adjustably couples the rearward ends of left and right sides, the rearward coupling element configured for adjusting a width of the semi-rigid element. The apparatus further includes a first elongated element that projects downwards from a left side of the semi-rigid element such that a tip of the first elongated element contacts a left shoulder of the shirt. The apparatus further includes a second elongated element that projects downwards such that a tip of the second elongated element contacts a right shoulder of the shirt.

17 Claims, 8 Drawing Sheets

(56) References Cited

U.S. PATENT DOCUMENTS

| | | | | | |
|---|---|---|---|---|---|
| 2,724,836 | A * | 11/1955 | Wiedemer | A41B 3/12 | 2/132 |
| 2,744,255 | A * | 5/1956 | Portias | A41B 3/06 | 2/132 |
| 3,565,301 | A * | 2/1971 | Mosser | B65D 85/182 | 2/132 |
| 8,296,865 | B2 | 10/2012 | Garcia | | |
| 9,717,280 | B2 * | 8/2017 | Truong | A41B 3/06 | |
| 9,750,285 | B2 * | 9/2017 | Davis | A41B 3/06 | |
| 2010/0313331 | A1 * | 12/2010 | English | A41B 3/06 | 2/132 |
| 2011/0113526 | A1 * | 5/2011 | Harris | A41B 3/06 | 2/132 |
| 2012/0023640 | A1 * | 2/2012 | Gutierrez Garcia | A41B 3/06 | 2/116 |
| 2014/0223640 | A1 * | 8/2014 | English | A41B 3/06 | 2/256 |
| 2015/0020290 | A1 * | 1/2015 | Yarbrough | A41B 3/06 | 2/129 |

* cited by examiner

ADJUSTABLE APPARATUS FOR STIFFENING A SHIRT COLLAR

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The disclosed embodiments broadly relate to the field of personal devices, and more particularly relates to the field of personal devices related to clothing for an individual.

BACKGROUND

A shirt collar comprises a piece of fabric that extends upwards from the shirt and then folds over to extend downwards towards the wearer's shoulders and back. When properly worn, a shirt collar exhibits qualities of sophistication and orderliness. In order to keep its proper shape, a shirt collar must possess some stiffness, thereby providing structural stabilization to the portion of the collar that extends upwards. For various reasons, collars can lose their stabilization and thereby lose their proper shape. The shirt collar may be wet, wrinkled or worn out, resulting in a drab or misshapen collar. This leads to an unacceptable appearance that is undesirable for users of collared shirts.

U.S. Pat. No. 8,296,865 to Gutierrez does provide a solution for stiffening the folded collars of a dress or collared shirt. However, U.S. Pat. No. 8,296,865 may not be able to properly adjust to different sizes of dress or collared shirts. In many cases, the apparatus provided by U.S. Pat. No. 8,296,865 is either too large or too small for certain dimensions of shirts. For example, the disclosed embodiments may be too large for a shirt designed to be worn by a child or small adult. As a result, there exists a need for an apparatus that can be used for different sizes of dress or collared shirts.

SUMMARY

An adjustable apparatus designed to operate with a shirt collar so as to provide stiffness to the shirt collar is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

Briefly, in one embodiment, an adjustable apparatus designed to operate with a shirt collar so as to provide stiffness to the shirt collar is disclosed. An adjustable apparatus designed to operate with a shirt collar so as to provide stiffness to the shirt collar. The apparatus comprises a circular, semi-rigid element for surrounding the shirt collar.

The semi-rigid element is coextensive with the shirt collar and includes a gap located at a placket of a shirt and wherein the semi-rigid element contacts an interior of a collar fold of the shirt collar. The circular, semi-rigid element comprises a left side defined by a first side element having a forward end adjustably coupled with a first elongated extension element. The first elongated extension element configured for adjusting a first length of the left side of the semi-rigid element. A right side is defined by a second side element having a forward end adjustably coupled with a second elongated extension element. The second elongated extension element is configured for adjusting a second length of the right side of the semi-rigid element. A rearward coupling element is configured for adjustably coupling a rearward end of the first side element with a rearward end of the second side element. The rearward coupling element is configured for adjusting a width of the semi-rigid element. A first elongated element is coupled to the left side of the semi-rigid element at a first distance from the forward end of the first side element. The first elongated element projects downwards at an acute angle from the left side towards a center point of the semi-rigid element and projects downwards at an acute angle towards the forward end of the first side element. A flat bottom end of the first elongated element contacts a shoulder of the shirt. A second elongated element is coupled to the right side of the semi-rigid element at a second distance from the forward end of the second side element. The second distance is equal to the first distance, and wherein the second elongated element projects downwards at an acute angle from the right side towards the center point of the semi-rigid element and projects downwards at an acute angle towards the forward end of the second side element. A flat bottom end of the second elongated element contacts a shoulder of the shirt. A juncture of the first elongated element and the semi-rigid element comprises an adjustable joint wherein the acute angles of the first elongated element are adjustable. A juncture of the second elongated element and the semi-rigid element comprises an adjustable joint wherein the acute angles of the second elongated element are adjustable.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the disclosed embodiments will be apparent from the following detailed description taken in conjunction with the accompanying drawings. Additionally, the left-most digit of a reference number identifies the drawing in which the reference number first appears.

DETAILED DESCRIPTION

Figure 1:
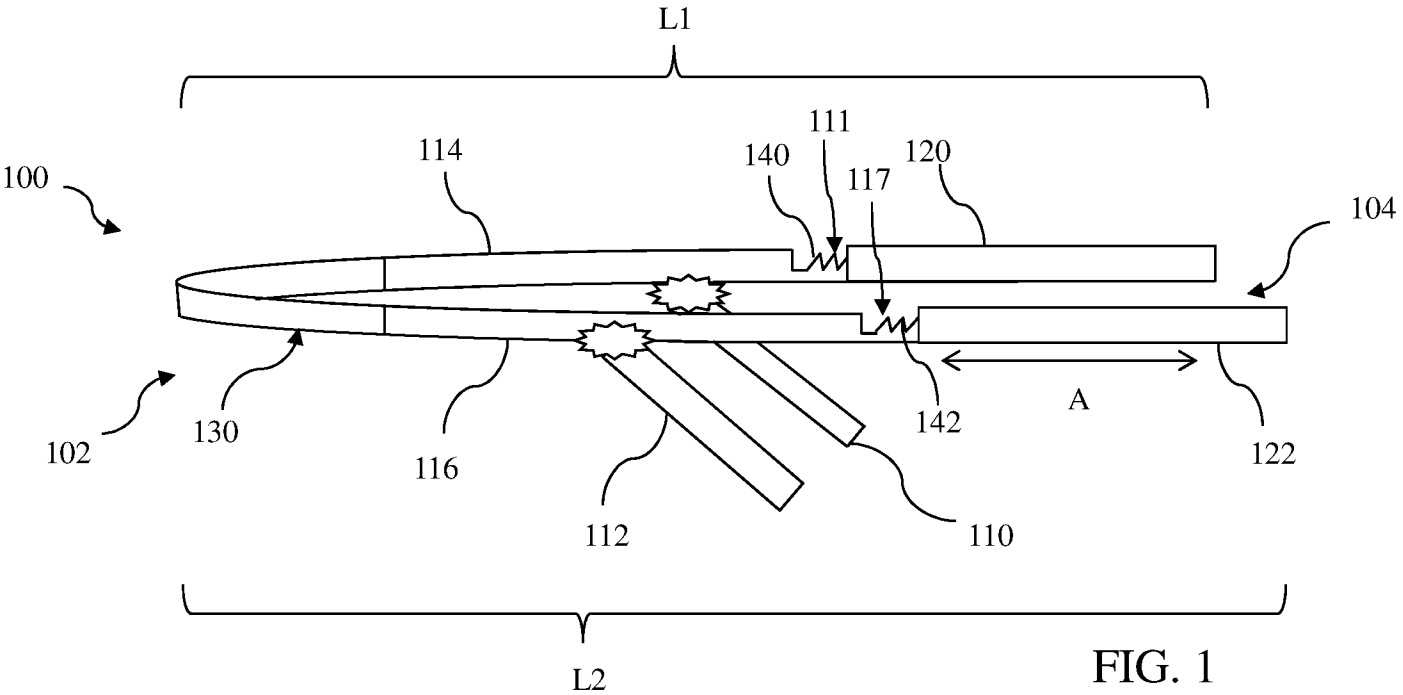
FIG. 1 is an illustration of a perspective side view of the apparatus for stiffening a shirt collar, wherein a first elongated extension element and second elongated extension element are in a partially extended position illustrating teeth on the forward ends of a first side element and second side element, in accordance with one embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering, or adding additional stages or components to the disclosed methods and devices. Accordingly, the following detailed description does not limit the disclosed embodiments. Instead, the proper scope of the disclosed embodiments is defined by the appended claims The disclosed embodiments improve upon the problems with the prior art by providing an apparatus that can have both an adjustable length and width to fit a wide range of sizes of collared and dress shirts. Referring now to the Figures, FIG. 1 is an illustration of a perspective view of the apparatus 100 for stiffening a shirt collar, in accordance with one embodiment. The apparatus 100 includes a circular element 102 having a substantially circular or oval shape and including a gap 104 in its circumference along its frontal side.

Figure 4:
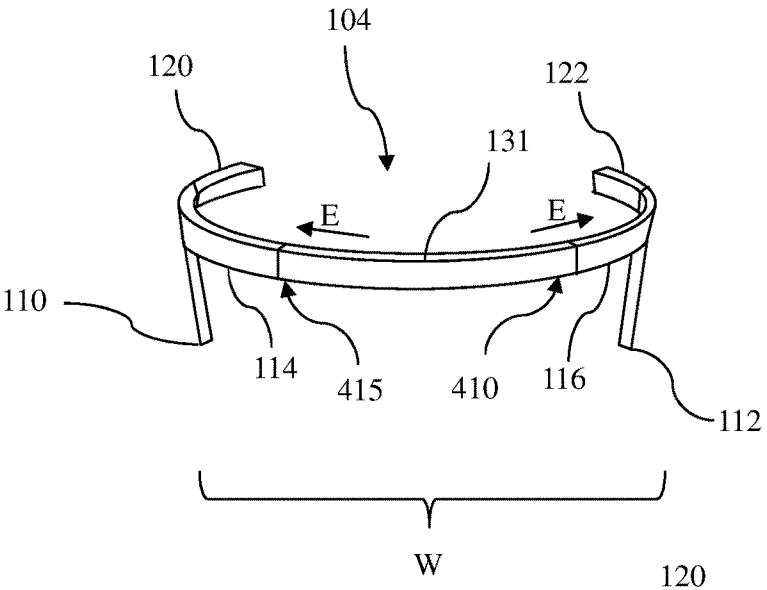
FIG. 4 is an illustration of a perspective rear view of the apparatus for stiffening a shirt collar illustrating a rearward coupling element coupled to the rearward ends of the first and second side elements in a non-extended position, in accordance with one embodiment.
Figure 5:
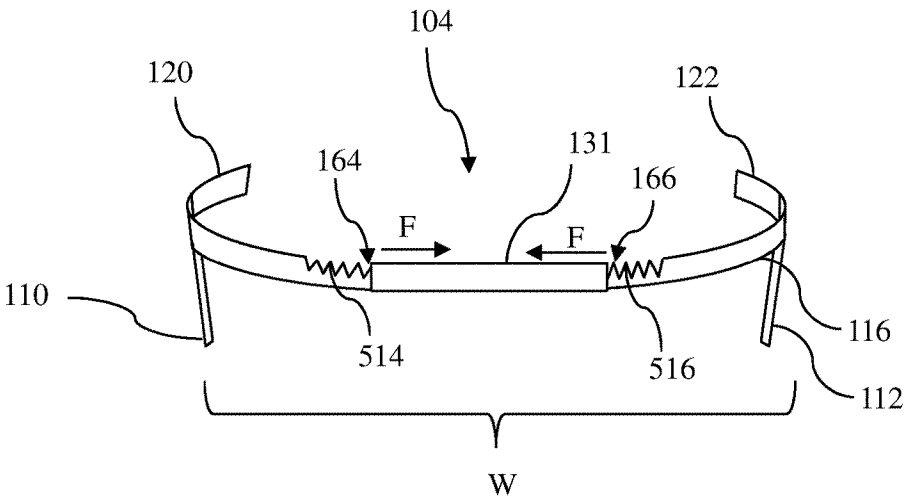
FIG. 5 is an illustration of a perspective rear view of the apparatus for stiffening a shirt collar illustrating a rearward coupling element coupled to the rearward ends of the first and second side elements in an extended position, in accordance with one embodiment.

The circular element is defined by a left side that includes a first side element 114 having a forward end 111 adjustably coupled with a first elongated extension element 120. The first elongated extension element is configured for adjusting a first length L1 of the left side of the semi-rigid circular element. A right side of the circular element is defined by a second side element 116 having a forward end 117 adjustably coupled with a second elongated extension element 122. The second elongated extension element is configured for adjusting a second length L2 of the right side of the semi-rigid element. A rearward coupling element or elongated sleeve 130 is configured for adjustably coupling a rearward end 164 of the first side element with a rearward end 166 of the second side element (as illustrated in FIGS. 4 and 5). The rearward coupling element is configured for adjusting a diameter or width W (as better illustrated in FIGS. 4 and 5) of the semi-rigid circular element. The lengths L1 and L2 and/or widths W can be increased or decreased in order to be fitted for different size collared and dress shirts.

Referring to FIGS. 1-7, the first side element 114 comprises a plurality of teeth 140 on its forward end. The teeth are configured to engage with a catching element (as illustrated as 605 in FIGS. 6 and 7) that protrudes from an inside surface of the first elongated extension element 120. The first elongated extension element comprises a first elongated sleeve that is configured to receive the first side element. The first elongated extension element is configured such that it can translate along the direction of line A (as illustrated in FIG. 1) when positioned on the forward end of the first side member. The first elongated extension element is configured so that it can be moved so that it extends or increases the length L1 of the left side.

Figure 6:
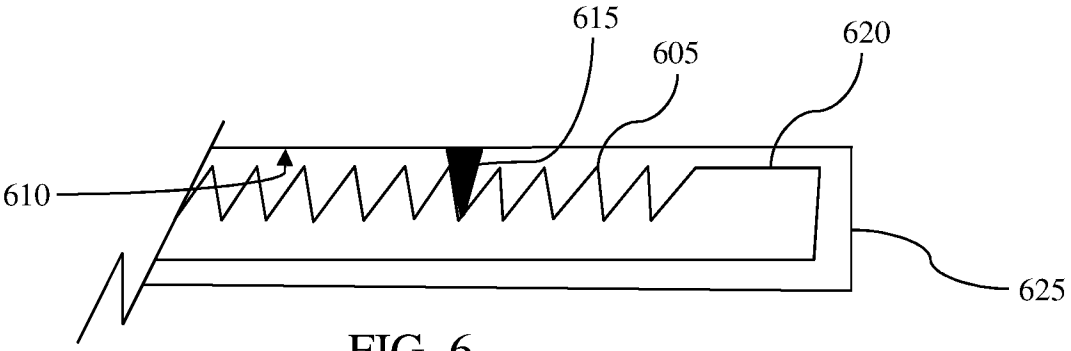
FIG. 6 is an illustration of a cross-sectional side view of a catching member of the apparatus in a first or non-extended position, in accordance with one embodiment.
Figure 7:
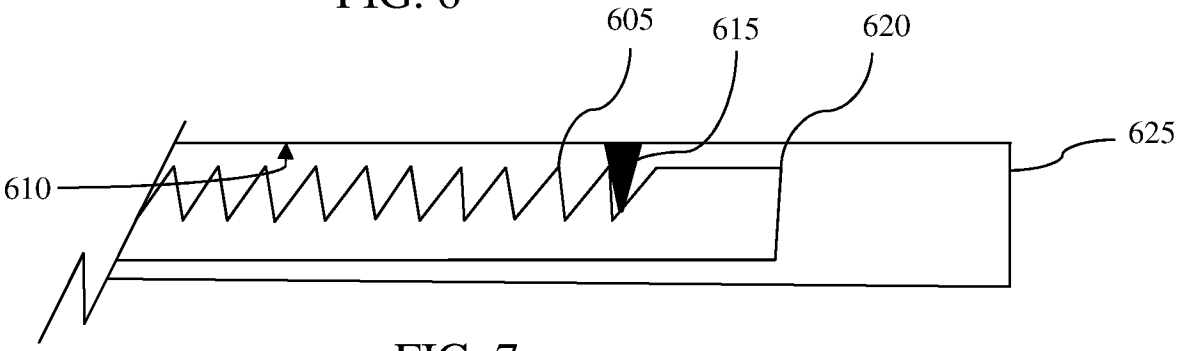
FIG. 7 is an illustration of a cross-sectional side view of a catching member of the apparatus in a second or extended position, in accordance with one embodiment.

Similarly, second side element 116 comprises a plurality of teeth 142 proximate to its forward end. The teeth are configured to engage with a catching element (as illustrated in FIGS. 6 and 7) of the second elongated extension element 122. The second elongated extension element comprises a second elongated sleeve that is configured to receive the second side element. The second elongated extension element is configured such that it can translate in the direction of line A (or along the longitudinal axis of the side element) when positioned on the forward end of the second side member. The second elongated extension element is configured so that it can be moved so that it extends or increases the length L2 of the right side of the circular element 102.

Figure 2:
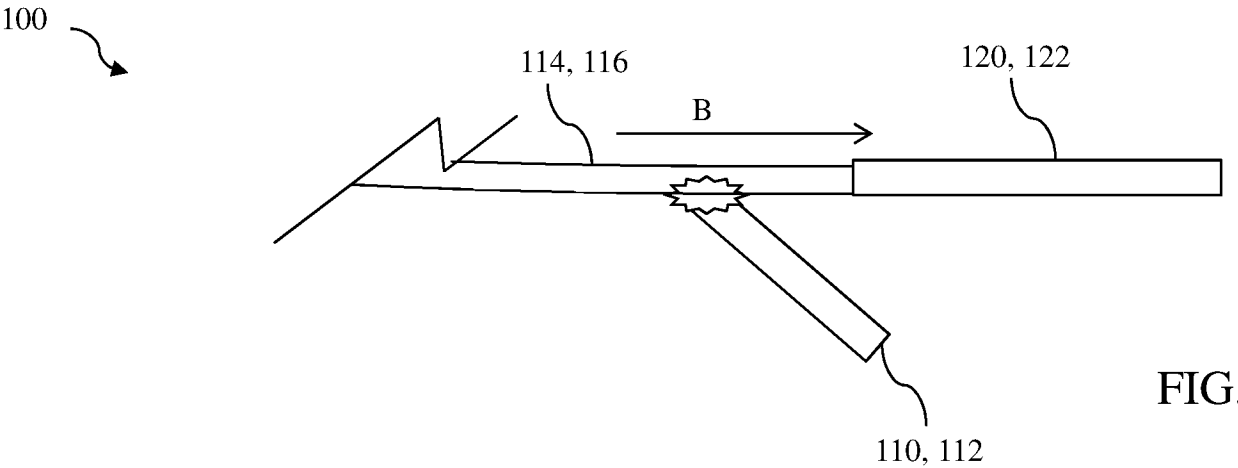
FIG. 2 is an illustration of a side view of the apparatus for stiffening a shirt collar, wherein the elongated extension elements are in a first position or non-extended position, in accordance with one embodiment.
Figure 3:
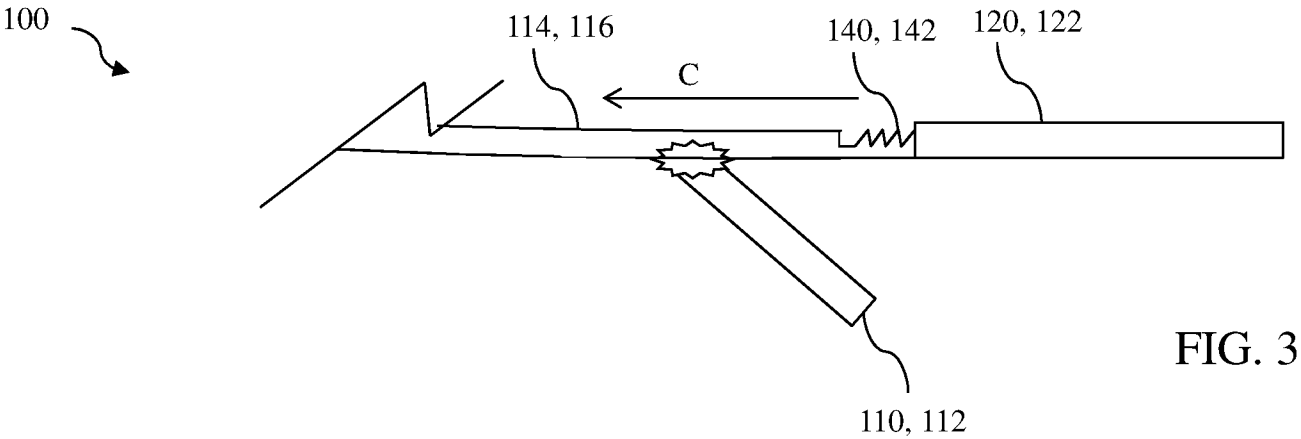
FIG. 3 is an illustration of a side view of the apparatus for stiffening a shirt collar, wherein the elongated extension elements are in a second or extended position, in accordance with one embodiment.

Referring to FIGS. 2 and 3, FIG. 2 is an illustration of a side view of the apparatus with the elongated extension element in a first position or non-extended position. FIG. 3 is an illustration of a side view of the apparatus with the elongated extension element in a second position or extended position. It is understood that FIGS. 2 and 3 can be used to describe both how the first elongated extension element 120 can be adjustably coupled with the first side element 114 in order to increase or decrease the length of the left side L1 of the circular element, and how the second elongated extension element 122 can be adjustably coupled with the second side element 116 in order to increase or decrease the length of the right side L2 of the circular element. The lengths L1, L2 can be increased or decreased in order to adjust for different sizes of collared or dress shirts. In the non-extended position as illustrated in FIG. 2, the sleeve of the elongated extension element 120, 122 is such that the lengths L1, L2 of the side elements are for a smaller sized shirt. In operation, in order to move from the non-extended (as illustrated in FIG. 2) to the extended or second position (as illustrated in FIG. 3), force is applied to the elongated extension element in the direction of line B thereby unsheathing the forward end of the side element from the sleeve. Conversely, when in the extended state, in order to move to the non-extended, force is applied to the elongated extension element in the direction of line C so that forward end of the side elements are sheathed by elongated extension element.

Referring to FIGS. 4 and 5, FIG. 4 is an illustration of a perspective rear view of the apparatus illustrating a rearward coupling element coupled with the first and second side elements in a non-extended or first position and FIG. 5 is an illustration of a perspective rear view of the apparatus illustrating the rearward coupling element coupled the first and second side elements in an extended or second position. The width W of the circular element can be increased or decreased in order to adjust for different sizes of collared or dress shirts. In the non-extended position as illustrated in FIG. 4, the coupling sleeve is coupled with side elements in a configuration that provides a width for a smaller sized shirt. The coupling sleeve 131 is a somewhat tubular shaped body having a left open end 415 for receiving a rearward end 164 of the first side element, and an opposing right open end 410 for receiving a rearward end 166 of the second element. Each open end of the coupling sleeve is configured to receive each rearward end of a side member similar to how an elongated extension member receives the forward end of the side element.

Referring to FIG. 4, the rearward coupling sleeve 131 has received the rearward ends of the side elements 114, 116 such that the sleeve is coupled with the rearward sides in a non-expanded state. In the non-expanded state, the width W of the circular element 102 is configured to receive smaller sized collared shirts. In order to move from an non-expanded state to an expanded state (as illustrated in FIG. 4) to the extended or second position (as illustrated in FIG. 5), force is applied to the elongated extension element in the direction of line E (along the longitudinal axis of circular element) on each side element thereby unsheathing the rearward end of each side element from the coupling sleeve 131. Conversely, when in the extended state, in order to move to the non-extended, force is applied to each side element in the direction of line F so that rearward ends of the side elements are sheathed or received by coupling element.

The operation of adjusting the width W of the circular element between the extended (as illustrated in FIG. 5) and the non-extended (as illustrated in FIG. 4) positions is similar to how the lengths L1, L2 are moved between the extended and non-extended positions. In operation, to move between from the non-extended or first position (as illustrated in FIG. 4) to the extended or second position (as illustrated in FIG. 5) force is applied in the direction of line E along the side elements 114, 116 so that side elements are moved out of the coupling sleeve. Conversely, to move between from the extended or second position (as illustrated in FIG. 5) to the non-extended or first position (as illustrated in FIG. 4) force is applied in the direction of line F along the side elements 114, 116 so that side elements are moved into the left and right sides of the coupling sleeve.

Regarding the rearward coupling element, a left catching element (similar to the catching element as illustrated in FIGS. 6 and 7) protrudes inwards from an inside surface of the left side of the rearward coupling element. The left catching element is for engaging a plurality of teeth 164 of the rearward end of first side element. A right catching element (similar to the catching element as illustrated in FIGS. 6 and 7) protrudes inwards from an inside surface of the right side of the rearward coupling element. The right catching element is for engaging a plurality of teeth 164 of the rearward end of the second side element and creates a stopping feature preventing translation of the sleeve relative to the side element.

Regarding the first side element, a first catching element (similar to the catching element as illustrated in FIGS. 6 and 7) protrudes inwards from an inside surface of the first elongated sleeve such that it engages the plurality of teeth 140 on the first side element and creates a stopping feature preventing translation of the sleeve relative to the side element. Similarly, regarding the second side element 116, a second catching element (similar to the catching element as illustrated in FIGS. 6 and 7 and further explained below) protrudes inwards from an inside surface of the second elongated sleeve 120 such that it engages the plurality of teeth 142 on the second side element and creates a stopping feature preventing translation of the sleeve relative to the side element.

FIGS. 6 and 7 are cross-sectional illustrations of a catching element 605 to engage teeth. The catching element 605 is one embodiment of the first catching element, second catching element, left catching element, and or right catching element that can be used to engage with the teeth 140, 142 of forward side members 114, 116 and/or teeth 514, 516 of the rearward ends of the first and second side members, respectively. FIG. 6 illustrates the sleeve receiving a side member in a first position such that the circular element is in a non-extended position. In the non-extended position, as mentioned above, either the width W or lengths L1, L2 are configured for smaller size collared or dress shirts. FIG. 7 illustrates the sleeve receiving a side member in a second position such that the circular element is in an extended position wherein, and as mentioned above, either the W or lengths L1, L2 are configured for larger sized shirts.

Referring to FIG. 6, the catching element 605 protrudes inwards from an inside surface of the sleeve 625 such that it engages the plurality of teeth 615. The catching element 605 may be an elongated shaped body or pawl having stiff and/or resilient properties. In the present embodiment, the catching element is a triangular shaped body, however, it is understood that other shapes are within the spirit and scope of the claimed subject matter. The catching element acts as a stopping feature so that the sleeve cannot translate relative to the teeth 615. The catching element's material's properties are such that a sufficient force must act on the sleeve element 625 or along the side element along the longitudinal axis (of either the first or second extension elements or the coupling sleeve) before the protruding catching feature will bend sideways enough in order for the teeth to translate relative to the sleeve. When the extension elements, side elements, and/or coupling sleeve are in either the first or second positions, and if a sufficient force does not act on either the first or second extension elements or the coupling sleeve, the catching feature will not bend, and therefore the catching feature will act as a stopping feature preventing the translation of the first or second extension elements or the coupling sleeves thereby maintaining the shape of the circular element. The inwardly protruding catching elements of the first extension member 120, second extension member 122, and/or coupling sleeve may comprise rubber, plastics, wood, metal, alloy or the like so as to provide sufficient resilient properties.

The first side member 114, second side member 116, first extension element 120, second extension element 122, and coupling sleeve of the rearward coupling element 130 defining the circular element 102 may comprise a semi-rigid material, such as plastic, metal, alloy or the like. The material that comprises the first side member, second side member, first extension element, second extension element, and coupling sleeve of the rearward coupling element is semi-rigid in that it provides limited flexibility. In one embodiment, the first side member, second side member, first extension element, second extension element, and coupling sleeve of the rearward coupling element provides only enough flexibility to allow the gap 104 to be manually opened just enough to allow placement of the element 102 around a shirt collar.

FIG. 1 further shows a first elongated element 110 that projects downward and forward at an acute angle from a left side of the circular element 102 and a second elongated element 112 that projects downward and forward at an acute angle from a right side of the circular element 102.

First and second elongated elements 110, 112 may be formed together with the side elements, 114, 116, respectively, so as to be structurally integrated with side elements. For example, the first and second elongated elements 110, 112 may be injection-molded together with the side elements 114, 116, respectively. Alternatively, first and second elongated elements 110, 112 may be coupled with the circular element 102 after formation.

In one embodiment, the exterior surface of first and second elongated elements 110, 112 and/or other elements of the circular element, including the rearward coupling element 130, side elements, 114, 116, elongated extension elements 120, 122, are covered in a rubber composite membrane. This membrane provides the exterior surface of first and second elongated elements 110, 112 and/or other elements of the circular element, including the rearward coupling element 130, side elements, 114, 116, and elongated extension elements 120, 122 with a tacky or texturized quality that aids in keeping the apparatus 100 in place when located within the fold of a shirt collar. The rubber coating may comprise one continuous, uninterrupted membrane that covers the entire exterior surface of first and second elongated elements 110, 112 and/or other elements of the circular element, including the rearward coupling element 130, side elements, 114, 116, and elongated extension elements 120, 122.

In another embodiment, the apparatus 100 includes a rubber tip that covers the tips or endpoints or components of the circular element, including the rearward coupling element 130, side elements, 114, 116, and elongated extension elements 120, 122 and/or the tips or endpoints of first and second elongated elements 110, 112. The rubber tips may comprise a strip that is wrapped around a tip or endpoint. The rubber tips serve to provide a bulbous element that cushions the tips of circular element, including the rearward coupling element 130, side elements, 114, 116, and elongated extension elements 120, 122, and/or first and second elongated elements 110, 112 so as to eliminate or reduce poking or jabbing of the wearer by apparatus 100.

Although FIG. 1 illustrates circular element, including the rearward coupling element 130, side elements, 114, 116, and elongated extension elements 120, 122, and/or first and second elongated elements 110, 112 to have a square-shaped or rectangular-shaped cross section, circular element, including the rearward coupling element 130, side elements, 114, 116, and elongated extension elements 120, 122, and/or first and second elongated elements 110, 112 may have a cross section that is circular, oval, pentagonal, or the like.

FIGS. 4 and 5 show that apparatus 100 includes the components defining the circular element 102 having a substantially circular or oval shape and including a gap 104 in its circumference along its frontal side. FIGS. 4 and 5 further show that the first elongated element 110 that projects downwards at an acute angle from a left side of the circular element 102 and second elongated element 112 that projects downward at an acute angle from a right side of the circular element 102. FIGS. 4 and 5 further show first elongated element 110 projects slightly inwards towards a neck of the wearer of apparatus 100. Likewise, second elongated element 112 projects slightly inwards towards a neck of the wearer.

Figure 8:
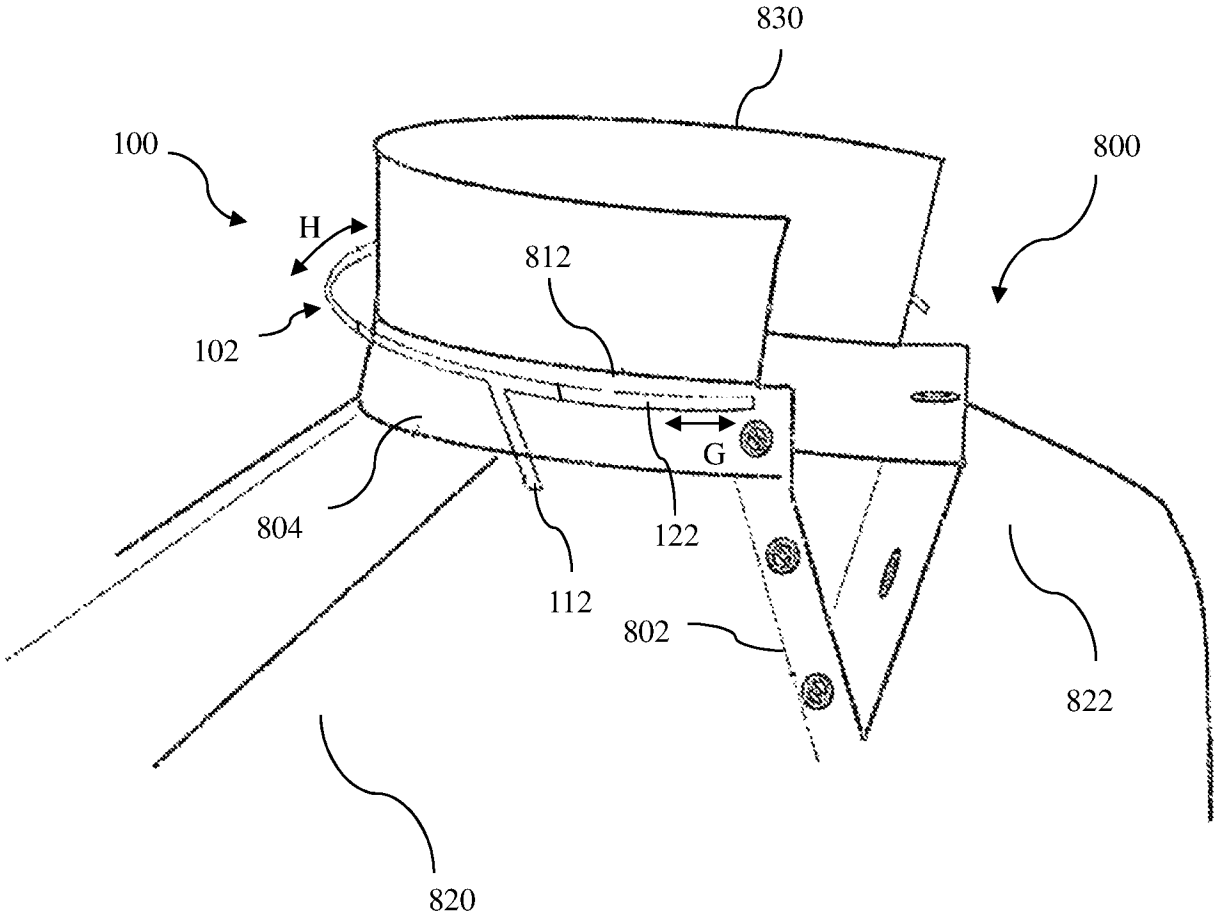
FIG. 8 is an illustration of a perspective view of the apparatus for stiffening a shirt collar of FIG. 1 in use on a collared shirt.

FIG. 8 is an illustration of a perspective view of the apparatus 100 for stiffening a shirt collar 810 of FIG. 1 in use on a collared shirt 800. FIG. 8 shows that shirt 800 includes a left shoulder area 822, which comprises an area of fabric of the shirt 800 that covers the left shoulder of the wearer. FIG. 8 also shows that shirt 800 includes a right shoulder area 820 which comprises an area of fabric of the shirt 800 that covers the right shoulder of the wearer.

Also shown in FIG. 8 is placket 802 of shirt 800, the placket comprising two strips that button together via a series of buttons and corresponding orifices. Shirt 800 also includes a collar strip 804 comprising a strip that surrounds the opening in the shirt 800 for the wearer's head. FIG. 8 also shows folding collar 810 connected at seam 812 to collar strip 804. The folding collar 810 is shown in FIG. 8 to be unfolded or "turned up" for exemplary purposes only.

FIG. 8 shows that apparatus 800 includes a circular element 802 having a substantially circular or oval shape and defined by the side members 114, 116, elongated extension elements, 120, 122 and rearward coupling element 130 being placed around the collar strip 804 and, more specifically, along the seam 812. Circular element 102 includes a gap 104 in its circumference along the area of the placket 802, such that the circular element 102 does not overlap or obscure the placket 802.

As mentioned above, force can be applied in either direction of line G (similar to as explained above) along the second elongated extension element 122 in order to increase or decrease the length of the second side of the circular element. Similarly, force can be applied (similar to as explained above) along the first elongated extension element 122 (not illustrated in FIG. 8) in order to increase or decrease the length of the first side 122 (not illustrated in FIG. 8) of the circular element. As mentioned above, this can be used to adjust for the different sizes of shirts as well as body types. Additionally, force can be applied in either direction of line H (similar to as explained above) along the rearward end of second side element or right end of the coupling sleeve in order to increase or decrease the width of the circular element. Similarly, force can be applied (similar to as explained above) along the rearward end of first side element (not shown) or left end of the coupling sleeve (not shown in FIG. 8) in order to increase or decrease the width of the circular element. As mentioned above, this can be used to adjust for the different sizes of shirts as well as body types.

FIG. 8 further shows second elongated element 112 that projects downward and forward at an acute angle from a right side of the circular element 102 such that the tip of the element 112 contacts the shoulder area 820 of the shirt 800. Also, first elongated element 110 (not shown) projects downward and forward at an acute angle from a left side of the circular element 102 and contacts the shoulder area 822 of the shirt 800.

Once placed in the correct position as per FIG. 8, the apparatus 100 is covered by folding down folding collar 810 at seam 812. This hides the apparatus 100 under the folding collar 810, thereby allowing for discrete use of the apparatus 100 without disclosing to a passerby that a device is being used to support the appearance of collar 810. The placement of apparatus 100 underneath the folding collar 810 provides structural support for the collar 810, thereby keeping the collar 810 upright and in the proper position. In one embodiment, the U-shaped circular element 102 provides a clamping effect on the collar strip 804, thereby holding the apparatus 100 firmly in place along the entire seam 812 but hidden behind collar 810. A rubber exterior of apparatus 100 further provides friction between the apparatus 100 and collar 910 so as to hold the apparatus 100 in place.

As shown in FIG. 1, the first and second elongated elements 110, 112 hold the collar 810 up or in the upwards direction. Ideally, the height of first and second elongated elements 110, 112 is the same as the height of collar strip 804. In one embodiment, in cases where the height of first and second elongated elements 110, 112 is not the same as the height of collar strip 804, the angle of the first and second elongated elements 110, 112 can be adjusted to have the same as the height of collar strip 804. That is, the acute angle between the first elongated element 110 and first side element 114 can be increased (up to a maximum of a ninety degree angle) to increase the height of first elongated element 110 to match the height of collar strip 804. Likewise, the acute angle between the first elongated element 110 and first side element 114 can be decreased to decrease the height of first elongated element 110 to match the height of collar strip 804. In a similar thread, the acute angle between the second elongated element 112 and second side element 116 can be increased to increase the height of second elongated element 112 and the acute angle between the second elongated element 112 and second side element 116 can be decreased to decrease the height of second elongated element 112. In this embodiment, first and second elongated elements 110, 112 possess adjustable joints to the first and second side elements 114, 116, respectively, that allow the angle between the first and second elongated elements 110, 112 the first and second side elements 114, 116, respectively, to be adjusted manually to a set angle. Once adjusted for a given shirt, the position of apparatus 100 within the shirt collar 810 is fixed and immobile and maintains the optimal shirt collar position irrespective of the movement of the shirt wearer. Still, apparatus 100 remains concealed by the shirt collar 810.

Figure 9:
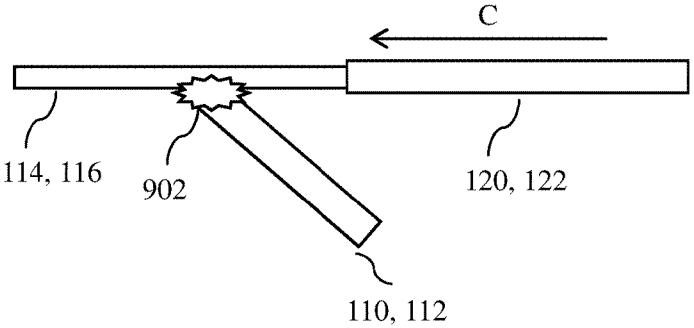
FIG. 9 is an illustration of a side view of the apparatus for stiffening a shirt collar, wherein the elongated extension elements are in a first position or non-extended position, in accordance with one embodiment.
Figure 10:
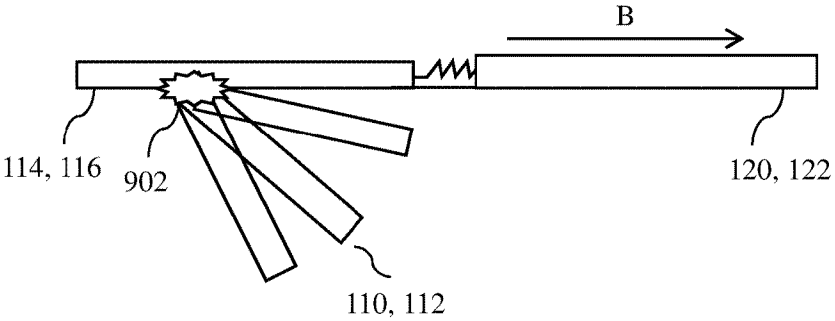
FIG. 10 is an illustration of a side view of the apparatus for stiffening a shirt collar, wherein the elongated extension elements are in a semi-extended position, in accordance with one embodiment.
Figure 11:
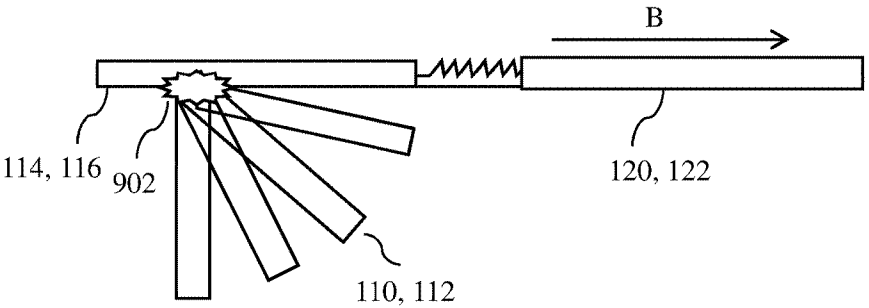
FIG. 11 is an illustration of a side view of the apparatus for stiffening a shirt collar, wherein the elongated extension elements are in a second or extended position, in accordance with one embodiment.

FIG. 9 is an illustration of a side view of the apparatus 100 for stiffening a shirt collar, wherein the elongated extension elements 120, 122 are in a first position or non-extended position, FIG. 10 shows the elongated extension elements are in a semi-extended position, and FIG. 11 shows the elongated extension elements are in a second or extended position, in accordance with one embodiment.

It is understood that FIGS. 9, 10, 11 can be used to describe both how the elongated extension elements 120, 122 can be adjustably coupled with the side elements 114, 116 in order to: a) increase or decrease the length of the left side L1 of the circular element, and b) increase or decrease the length of the right side L2 of the circular element. The lengths L1, L2 can be increased or decreased in order to adjust for different sizes of collared or dress shirts. In the non-extended position as illustrated in FIG. 9, the sleeve of the elongated extension element 120, 122 is such that the lengths L1, L2 of the side elements are for a smaller sized shirt. In operation, in order to move from the non-extended (as illustrated in FIG. 9) to the semi-extended position (as illustrated in FIG. 10) and then to the extended or second position (as illustrated in FIG. 11), force is applied to the elongated extension element 120, 122 in the direction of line B thereby unsheathing the forward end of the side element from the sleeve. Conversely, when in the extended state, in order to move to the non-extended position, force is applied to the elongated extension element in the direction of line C so that the forward end of the side elements are sheathed by the elongated extension element.

Recall that first and second elongated elements 110, 112 may be formed together with the side elements, 114, 116, respectively, so as to be structurally integrated with side elements. For example, the first and second elongated elements 110, 112 may be injection-molded together with the side elements 114, 116, respectively. Alternatively, first and second elongated elements 110, 112 may be coupled with the circular element 102 after formation. FIGS. 9, 10 and 11 also show that the first and second elongated elements 110, 112 may be rotatably coupled with the side elements, 114, 116, respectively, so as to rotate about a pivot point 902. This allows the first and second elongated elements 110, 112 to be adjusted for height, to accommodate varying sizes or heights of collars, varying sizes of shirts, and varying sizes of necks, upper torso or chin areas.

Figure 12:
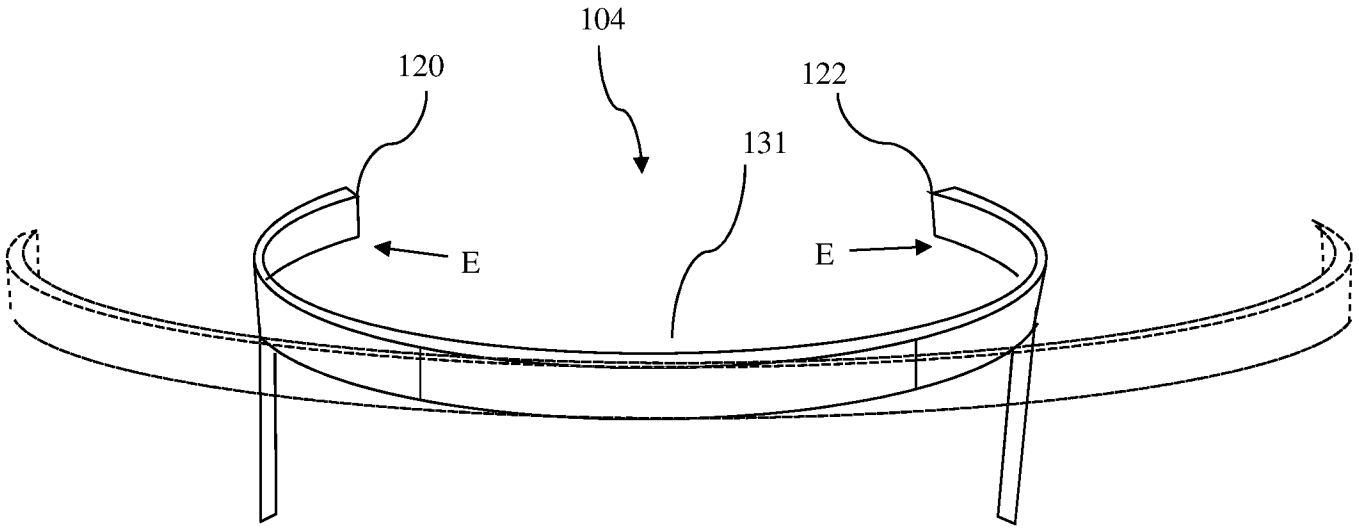
FIG. 12 is an illustration of a perspective rear view of the apparatus for stiffening a shirt collar illustrating the elasticity of the device, in accordance with one embodiment.

FIG. 12 is an illustration of a perspective rear view of the apparatus 100 for stiffening a shirt collar illustrating the elasticity of the device, in accordance with one embodiment. FIG. 12 shows the device 100 in a non-expanded state, but an outward force E may be applied to the elongated extension elements 120, 122 in the direction of line E (perpendicular to the circular element), thereby pushing the elongated extension elements 120, 122 outwards and making a wider gap 104. This allows the device 100 to accommodate persons with thicker necks, or otherwise persons with varying sizes of necks, upper torso or chin areas. Additionally, in one embodiment, the device 100 (or any of its components, such as 120, 122, 114, 116, 110, 112 and 131) may be coated, covered or surrounded by a coating of rubber, flock, wool, cotton, fiber, velvet, cloth, paper, any combination of the above, or any other suitable material. This feature allows the apparatus 100 to be free from sliding around, and secures the apparatus 100 to its place inside the collar of the wearer.

Figure 13:
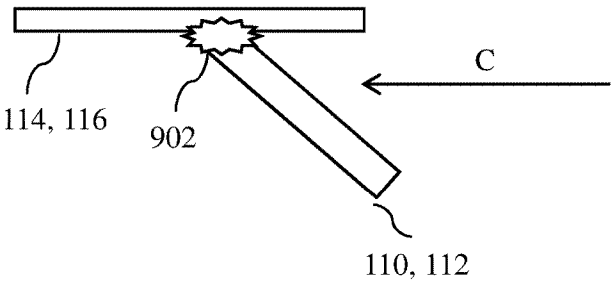
FIG. 13 is an illustration of a side view of the apparatus for stiffening a shirt collar, wherein the elongated elements are shown in a first position, in accordance with one embodiment.
Figure 14:
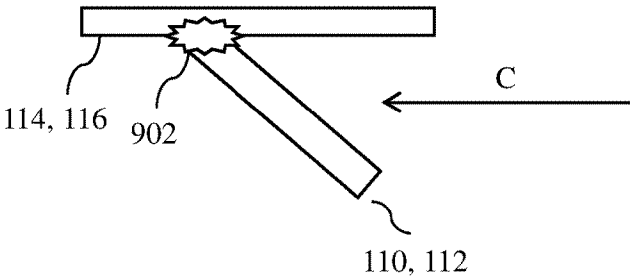
FIG. 14 is an illustration of a side view of the apparatus for stiffening a shirt collar, wherein the elongated elements are in a second position, in accordance with one embodiment.
Figure 15:
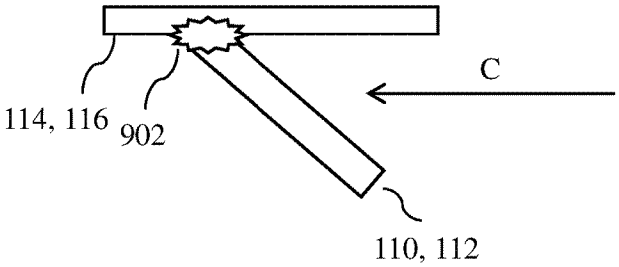
FIG. 15 is an illustration of a side view of the apparatus for stiffening a shirt collar, wherein the elongated elements are in a third position, in accordance with one embodiment.

FIG. 13 is an illustration of a side view of the apparatus 100 for stiffening a shirt collar, wherein the elongated elements 110, 112 are shown in a first position, in accordance with one embodiment. Recall that the first and second elongated elements 110, 112 may be rotatably coupled with the side elements, 114, 116, respectively, so as to rotate about a pivot point 902. This allows the first and second elongated elements 110, 112 to be adjusted for height, to accommodate varying sizes or heights of collars, varying sizes of shirts, and varying sizes of necks, upper torso or chin areas. FIGS. 13-15, however, show that the first and second elongated elements 110, 112 may also be slidably coupled with the side elements, 114, 116, respectively, such that the pivot point 902 may slide from a first position (see FIG. 13) on element 114, 116, to a second position (see FIG. 14) on element 114, 116, to a third position (see FIG. 15) on element 114, 116. This allows the first and second elongated elements 110, 112 to be adjusted for location on the element 114, 116, to accommodate the different places on which the user desires to provide support on a collar. FIG. 14 is an illustration of a side view of the apparatus 100 for stiffening a shirt collar, wherein the elongated elements 110, 112 are in a second position, in accordance with one embodiment. FIG. 15 is an illustration of a side view of the apparatus 100 for stiffening a shirt collar, wherein the elongated elements 110, 112 are in a third position, in accordance with one embodiment. In operation, in order to move from the first position (as illustrated in FIG. 13) to the second position (as illustrated in FIG. 14) and then to the third position (as illustrated in FIG. 15), force is applied to the element 110, 112 in the direction of line C thereby sliding the pivot point 902 along element 114, 116.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. An adjustable apparatus designed to operate with a shirt collar so as to provide stiffness to the shirt collar, the apparatus consisting of:

a circular, semi-rigid element for surrounding the shirt collar, wherein the semi-rigid element is configured to be coextensive with the shirt collar that includes a gap located at a placket of a shirt and wherein the semi-rigid element is configured to contact an interior of a collar fold of the shirt collar, the circular, semi-rigid element comprising:

a left side defined by a first side element having a forward end adjustably coupled with a first elongated extension element, the first elongated extension element configured for adjusting a first length of the left side of the semi-rigid element;

a right side defined by a second side element having a forward end adjustably coupled with a second elongated extension element, the second elongated extension element configured for adjusting a second length of the right side of the semi-rigid element; and, a rearward coupling element for adjustably coupling a rearward end of the first side element with a rearward end of the second side element, wherein the rearward coupling element is configured for adjusting a diameter of the semi-rigid element;

a first elongated element coupled to the left side of the semi-rigid element at a first distance from the forward end of the first side element, wherein the first elongated element projects downwards at an acute angle from the left side towards a center point of the semirigid element and projects downwards at an acute angle towards the forward end of the first side element, and wherein a flat bottom end of the first elongated element is configured to contact a shoulder of the shirt;

a second elongated element coupled to the right side of the semi-rigid element at a second distance from the forward end of the second side element, wherein the second distance is equal to the first distance, and wherein the second elongated element projects downwards at an acute angle from the right side towards the center point of the semi-rigid element and projects downwards at an acute angle towards the forward end of the second side element, and wherein a flat bottom end of the second elongated element is configured to contact a shoulder of the shirt;

wherein a juncture of the first elongated element and the semi-rigid element comprises an adjustable joint wherein the acute angles of the first elongated element are adjustable; and wherein a juncture of the second elongated element and the semi-rigid element comprises an adjustable joint wherein the acute angles of the second elongated element are adjustable.

2. The apparatus of claim 1, wherein the first side element comprises a plurality of teeth, wherein the first elongated extension element comprises a first elongated sleeve configured to receive the first side element, wherein a first catching element protrudes inwards from an inside surface of the first elongated sleeve such that it engages the plurality of teeth on the first side element.

3. The apparatus of claim 2, wherein the second side element comprises a plurality of teeth, wherein the second elongated extension element comprises a second elongated sleeve configured to receive the second side element, wherein a second catching element protrudes inwards from an inside surface of the second elongated sleeve such that it engages the teeth on the second side element.

4. The apparatus of claim 1, wherein the rearward coupling element comprises:

a coupling sleeve having a left side for receiving a rearward end of the first side element, the coupling sleeve having a right side for receiving a rearward end of the second side element;

a left catching element protruding inwards from an inside surface of the left side of the rearward coupling element, and wherein the left catching element is for engaging a plurality of teeth of the rearward end of first side element; and, a right catching element protrudes inwards from an inside surface of the right side of the rearward coupling element, and wherein the right catching element is for engaging a plurality of teeth of the rearward end of second side element.

5. The apparatus of claim 1, wherein the first and second elongated elements comprise a metallic interior surrounded by a rubber composite exterior.

6. The apparatus of claim 4, wherein the first side element, second side element, first elongated extension element, second elongated extension element and rearward coupling element each comprise a metallic interior surrounded by a rubber composite exterior.

7. The apparatus of claim 2, wherein the first elongated element comprises a metallic interior integrally formed with the first side element and the second elongated element comprises a metallic interior integrally formed with the second side element.

8. The apparatus of claim 1, wherein the first elongated element comprises a rubber composite exterior integrally formed with the first side element and the second elongated element comprises a rubber composite exterior integrally formed with the second side element.

9. The apparatus of claim 1, wherein the first side element, second side element, first elongated extension element, second elongated extension element and rearward coupling element each comprise a plastic interior surrounded by a rubber composite exterior.

10. The apparatus of claim 5, wherein the first and second elongated elements each comprise a plastic interior integrally formed with the semi-rigid element.

11. The apparatus of claim 1, wherein the first extension element has a terminating end comprising a rubber tip.

12. The apparatus of claim 11, wherein the rubber tip comprises a strip that is wrapped around a terminating end of the first extension element.

13. The apparatus of claim 11, wherein the semi-rigid element has a second end comprising another rubber tip.

14. An adjustable apparatus designed to operate with a shirt collar so as to provide stiffness to the shirt collar, the apparatus consisting of:

a circular, semi-rigid element for surrounding the shirt collar, wherein the semi-rigid element is configured to be coextensive with the shirt collar that includes a gap located at a placket of a shirt and wherein the semi-rigid element is configured to contact an interior of a collar fold of the shirt collar, the circular, semi-rigid element comprising:

a left side defined by a first side element having a forward end adjustably coupled with a first elongated extension element, the first side element having a plurality of teeth;

a first elongated extension element configured for adjusting a first length of the left side of the semi-rigid element, the first elongated extension element comprises a first elongated sleeve configured to receive the first side element, wherein a first catching element protrudes inwards from an inside surface of the first elongated sleeve such that it engages the plurality of teeth on the first side element;

a right side defined by a second side element having a forward end adjustably coupled with a second elongated extension element, the second side element having a plurality of teeth;

a second elongated extension element configured for adjusting a second length of the right side of the semi-rigid element, the second elongated extension element comprises a second elongated sleeve configured to receive the second side element, wherein a second catching element protrudes inwards from an inside surface of the second elongated sleeve such that it engages the plurality of teeth on the second side element; and, a rearward coupling element for adjustably coupling a rearward end of the first side element with a rearward end of the second side element, wherein the rearward coupling element is configured for adjusting a diameter of the semi-rigid element;

a first elongated element coupled to the left side of the semi-rigid element at a first distance from the forward end of the first side element, wherein the first elongated element projects downwards at an acute angle from the left side towards a center point of the semi-rigid element and projects downwards at an acute angle towards the forward end of the first side element, and wherein a flat bottom end of the first elongated element is configured to contact a shoulder of the shirt;

a second elongated element coupled to the right side of the semi-rigid element at a second distance from the forward end of the second side element, wherein the second distance is equal to the first distance, and wherein the second elongated element projects downwards at an acute angle from the right side towards the center point of the semi-rigid element and projects downwards at an acute angle towards the forward end of the second side element, and wherein a flat bottom end of the second elongated element is configured to contact a shoulder of the shirt;

wherein a juncture of the first elongated element and the semi-rigid element comprises an adjustable joint wherein the acute angles of the first elongated element are adjustable;

wherein a juncture of the second elongated element and the semi-rigid element comprises an adjustable joint wherein the acute angles of the second elongated element are adjustable; and, a bulbous rubber element located at a terminating end of the first extension element and a bulbous rubber element located at a terminating end of the second extension element.

15. The apparatus of claim 14, wherein the first side element, second side element, first elongated extension element, second elongated extension element and rearward coupling element each comprise a metallic interior surrounded by a rubber composite exterior.

16. The apparatus of claim 14, wherein the first side element, second side element, first elongated extension element, second elongated extension element and rearward coupling element each comprise a plastic interior surrounded by a rubber composite exterior.

17. An adjustable apparatus designed to operate with a shirt collar so as to provide stiffness to the shirt collar, the apparatus consisting of:

a circular, semi-rigid element for surrounding the shirt collar, wherein the semi-rigid element is configured to be coextensive with the shirt collar that includes a gap located at a placket of a shirt and wherein the semi-rigid element is configured to contact an interior of a collar fold of the shirt collar, the circular, semi-rigid element comprising:

a left side defined by a first side element having a forward end adjustably coupled with a first elongated extension element, the first side element having a plurality of teeth;

a first elongated extension element configured for adjusting a first length of the left side of the semi-rigid element, the first elongated extension element comprises a first elongated sleeve configured to receive the first side element, wherein a first catching element protrudes inwards from an inside surface of the first elongated sleeve such that it engages the plurality of teeth on the first side element;

a right side defined by a second side element having a forward end adjustably coupled with a second elongated extension element, the second side element having a plurality of teeth;

a second elongated extension element configured for adjusting a second length of the right side of the semi-rigid element, the second elongated extension element comprises a second elongated sleeve configured to receive the second side element, wherein a second catching element protrudes inwards from an inside surface of the second elongated sleeve such that it engages the plurality of teeth on the second side element;

a rearward coupling element for adjustably coupling a rearward end of the first side element with a rearward end of the second side element, wherein the rearward coupling element is configured for adjusting a diameter of the semi-rigid element;

a first elongated element coupled to the left side of the semi-rigid element at a first distance from the forward end of the first side element, wherein the first elongated element projects downwards at an acute angle from the left side towards a center point of the semi-rigid element and projects downwards at an acute angle towards the forward end of the first side element, and wherein a flat bottom end of the first elongated element is configured to contact a shoulder of the shirt;

a second elongated element coupled to the right side of the semi-rigid element at a second distance from the forward end of the second side element, wherein the second distance is equal to the first distance, and wherein the second elongated element projects downwards at an acute angle from the right side towards the center point of the semi-rigid element and projects downwards at an acute angle towards the forward end of the second side element, and wherein a flat bottom end of the second elongated element is configured to contact a shoulder of the shirt;

wherein a juncture of the first elongated element and the semi-rigid element comprises an adjustable joint wherein the acute angles of the first elongated element are adjustable;

wherein a juncture of the second elongated element and the semi-rigid element comprises an adjustable joint wherein the acute angles of the second elongated element are adjustable; and, a bulbous rubber element located at a terminating end of the first extension element and a bulbous rubber element located at a terminating end of the second extension element.

* * * * *